United States Patent [19]

Mangum et al.

[11] 3,954,526

[45] May 4, 1976

[54] METHOD FOR MAKING COATED ULTRA-FINE AMMONIUM PERCHLORATE PARTICLES AND PRODUCT PRODUCED THEREBY

[75] Inventors: Grafton F. Mangum; Rudy E. Rogers, both of Huntsville; Edward J. Schreck, Decatur, all of Ala.

[73] Assignee: Thiokol Corporation, Newtown, Pa.

[22] Filed: Feb. 22, 1971

[21] Appl. No.: 117,528

[52] U.S. Cl. ..... 149/7; 149/19.9; 149/19.91; 149/76; 149/113; 427/57; 427/215; 427/220; 427/221

[51] Int. Cl.² ..... C06B 29/22; C06B 45/32

[58] Field of Search ... 117/100 B, 161 UF, 161 UC, 117/161 UH, 16; 264/3 E, 3 R; 149/7, 19, 76, 113, 21, 19.9, 19.91; 427/57, 215, 220, 221

[56] References Cited

UNITED STATES PATENTS

| | | | |
|---|---|---|---|
| 2,027,114 | 1/1936 | Olsen et al. | 264/3 |
| 2,973,257 | 2/1961 | Ryker | 264/3 X |
| 3,160,535 | 12/1964 | Wells | 149/7 |
| 3,190,776 | 6/1965 | Ender | 149/7 X |
| 3,222,231 | 12/1965 | Markels | 117/100 X |
| 3,226,784 | 1/1966 | Owen et al. | 117/100 X |
| 3,235,589 | 2/1966 | Berenbaum et al. | 117/100 X |
| 3,452,445 | 7/1969 | Higgins | 117/100 X |
| 3,523,839 | 8/1970 | Shechter et al. | 117/100 X |
| 3,539,377 | 11/1970 | Steinle | 117/100 X |
| 3,563,966 | 2/1971 | Lowrey et al. | 117/100 X |

FOREIGN PATENTS OR APPLICATIONS

| | | | |
|---|---|---|---|
| 14,866 | 10/1915 | United Kingdom | 149/7 |
| 689,283 | 3/1953 | United Kingdom | 149/7 |

*Primary Examiner*—Benjamin R. Padgett
*Assistant Examiner*—Edward A. Miller

[57] ABSTRACT

Sub-micron particle size ammonium perchlorate particles are made by mixing a solution of ammonium perchlorate in a volatile liquid with a second less volatile liquid which is miscible with the first liquid and is a non-solvent for ammonium perchlorate. The resulting mixture is heated to vaporize the volatile liquid and form a suspension of fine ammonium perchlorate particles in the second liquid. A particle coating agent soluble in the second liquid is used to limit particle growth. The particles are coated with the coating agent and may be recovered from the suspension by vaporization of the second liquid to form a powder, or by partial evaporization of the second liquid to form a concentrated slurry or paste in which the ammonium perchlorate is the disperse phase. The ultra-fine particles formed are suitable for use in propellant formulations.

23 Claims, 1 Drawing Figure

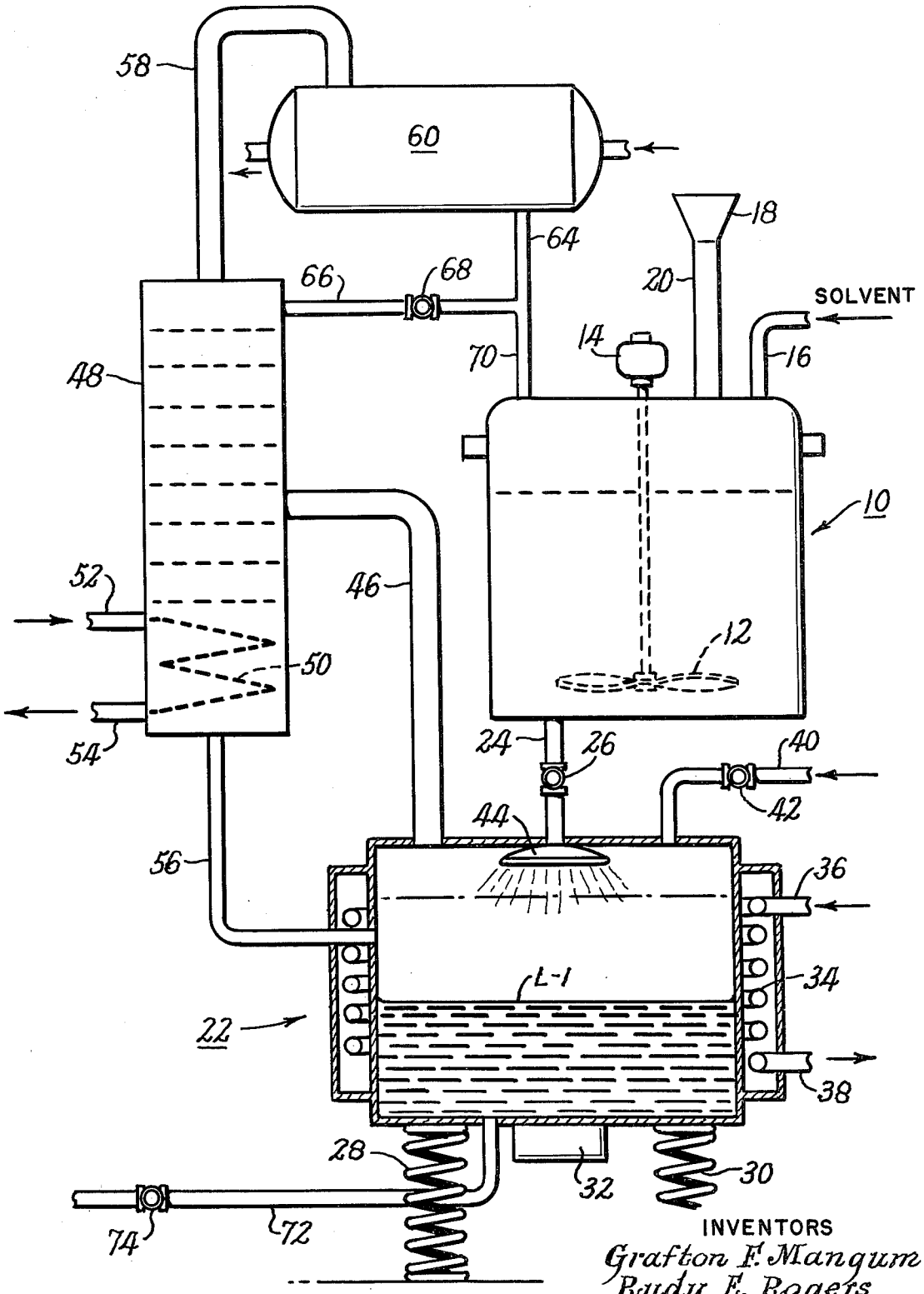
INVENTORS
Grafton F. Mangum
Rudy E. Rogers
Edward J. Schreck
BY
Curtis, Morris & Safford
ATTORNEYS

METHOD FOR MAKING COATED ULTRA-FINE AMMONIUM PERCHLORATE PARTICLES AND PRODUCT PRODUCED THEREBY

This invention relates to the manufacture of ammonium perchlorate of a particle size adapted to be used in rocket propellants and more particularly to a novel method of making ammonium perchlorate in the form of ultra-fine particles.

Most solid rocket propellants are principally composed of a polymeric fuel-binder having a finely divided oxidizer, usually ammonium perchlorate, dispersed therein. The oxidizer, a curing agent for the polymeric binder, and certain special purpose ingredients known in the art are dispersed in the binder while the latter is in viscous fluid form, and the resulting mixture is cast in situ in a rocket motor casing at a temperature sufficient to convert the binder to elastomeric form.

It is known that the efficiency and rate of combustion of a solid propellant can be maximized by increasing the area of contact between the oxidizer and other ingredients of the propellant composition and that this area of contact can be increased by reducing the particle size of the oxidizer. Consequently, rocket propellant oxidizers, prior to their incorporation in the fuel-binder, have customarily been subjected to one or more mechanical grinding operations. However, such grinding operations are subject to a number of disadvantages. Thus they involve a considerable explosion hazard and numerous precautions must be taken to minimize the risk of explosion. Moreover, the risk of explosion can never be completely eliminated. Also there is a tendency for the ammonium perchlorate to become contaminated by material removed from the grinder and grinding media. In addition, grinding is a relatively expensive procedure and it has not been found possible to reduce the particle size of the oxidizer by grinding to the extent that is desirable for highly efficient propellant combustion.

Because of the foregoing disadvantages various proposals have previously been made for producing finely particulate oxidizers other than by grinding. Thus U.S. Pat. No. 3,452,445 discloses a process for making fine particles of ammonium perchlorate by quick freezing of aqueous ammonium perchlorate. Freezing of the aqueous solution is effected by rapidly rotating a flask containing the solution in an acetone-dry ice bath. The ice thus formed is then sublimed under a reduced pressure to recover ammonium perchlorate particles having an average size of 1.7 to 2.1 microns.

U.S. Pat. No. 3,222,231 to Markels Jr. et al. discloses a process wherein a saturated aqueous solution of ammonium perchlorate at a temperature of 95°C. is simultaneously agitated and subjected to ultra-sonic vibrations over a period of several hours. As the solution cools, ammonium perchlorate crystals precipitate and are subsequently removed from the solution, washed with acetone and ether, and dried. The product crystals had a particle size within the range 5 to 350 microns.

While such processes avoid the explosion hazards involved in mechanical grinding, the size of the ammonium perchlorate particles they produce is of the same order of magnitude as, or in some cases larger than, that produced by the grinding process. It is accordingly an object of the present invention to provide a process for preparing ultrafine ammonium perchlorate, i.e., ammonium perchlorate having an average particle size of less than 1 micron. It is another object of the invention to provide a process for making ammonium perchlorate which eliminates the explosion hazard involved in the grinding operation referred to above. It is another object of the invention to provide a process for making ultrafine ammonium perchlorate of high purity at a low unit cost. It is still another object of the invention to provide such a process that can be readily automated. It is a still further object of the invention to provide a process wherein for any given production rate the quantity of material being processed is relatively small. It is still another object of the invention to provide fine ammonium perchlorate particles in a form in which they can be more readily incorporated in a propellant composition. Other objects of the invention will be in part obvious and in part pointed out hereafter.

The objects of the invention are achieved, in general, by mixing a solution of ammonium perchlorate in a volatile liquid with a second less volatile liquid which is miscible with the first liquid and is a non-solvent for ammonium perchlorate, and simultaneously agitating the mixture and vaporizing the solvent liquid to form a suspension of fine ammonium perchlorate particles in the second liquid. Precipitation of the ammonium perchlorate in a non-solvent to some extent tends to arrest the growth of the crystals. However, in order to obtain the desired sub-micron particles, it has been found necessary to use one or more particle coating agents which are dissolved or dispersed in the non-solvent or the solvent or both. The types of coating agents that are useful in the present process are discussed in detail hereafter. In general, they may be hydrocarbon polymers of a type commonly used as fuel-binders in propellant compositions or very fine particle size inert solids or certain surface active agents.

After the volatile solvent has been vaporized, the ammonium perchlorate suspended in the non-solvent in the form of a slurry is recovered. Because of the small size of the particles conventional filtration is impractical. Accordingly, the ammonium perchlorate is recovered by evaporation of the non-solvent using any of several different procedures. For example, the slurry may be added directly to the propellant mixture and the non-solvent vaporized during the course of the propellant mixing step. Alternatively, a portion of the non-solvent may be evaporated to form a concentrated slurry which is then added to the propellant formulation in the mixer. In cases where the coating agent is a liquid hydrocarbon polymer and is used in a substantial amount, say 15% or more by weight of the perchlorate, all of the non-solvent can be evaporated to yield a paste which can then be added to the propellant mixer. In other cases a small amount of the liquid hydrocarbon polymer can be used, either with or without another coating agent, and the non-solvent evaporated to form a dry, free flowing powder, the particles of which are polymer-coated. Such a powder can be stored in a dry environment for extended periods of time without significant change in its particle size.

As the crystals form in the non-solvent, they become coated with the coating agent and this coating inhibits growth of the crystals during the evaporation of the non-solvent and during storage. As pointed out above, it has been found that the surface active agent may be a hydrocarbon polymer of the type used as a fuel binder in propellant compositions. Particles coated with such a polymer have the important advantage that they can be more readily incorporated in the propellant mix and ensure a high degree of uniformity in the distribution of the oxidizer throughout the propellant.

In general, the choice of solvents and non-solvents for use in accordance with the present invention is limited by the following requirements: (1) ammonium perchlorate must be soluble in the solvent and insoluble in the non-solvent; (2) the non-solvent must have a higher boiling point than the solvent; (3) the two liquids should desirably be completely miscible and at least miscible in the proportions in which they are used; (4) the solvent or non-solvent, preferably the non-solvent, must be capable of dissolving the coating agent; and (5) the nature of the two liquids should be such that they do not form an azeotropic mixture which interferes with effective removal of the solvent. Suitable solvent liquids include methanol, ethanol, and acetone. Suitable non-solvents include xylene and halogenated xylenes, mono-, di- and trichlorobenzene, $CCl_2F.CCl_2F$ (Freon 112), $CCl_2F.CClF_2$ (Freon 113), n-hexane, carbon tetrachloride, benzene and toluene. Solvent/non-solvent pairs that have been found particularly useful are methanol-xylene, methanol-chlorobenzene, acetone-chlorobenzene and acetone-Freon 112. Acetone-Freon 112 is especially useful from the standpoint of its relatively high ignition temperature, good miscibility and low heats of vaporization. Methanol is especially useful because of the high solubility of ammonium perchlorate therein.

Agitation of the liquid mixture during recrystallization is essential to obtain the desired sub-micron size ammonium perchlorate particles. Agitation may be effected by means of an air- or motor-driven impeller or by subjecting the mixture to ultra-sonic vibrations. It has been found that ultra-sonic agitation of the liquid mixture gives somewhat better results than mechanical agitation. Ultra-sonic generators are well known in the art and any suitable type of acoustic generator such as the piezoelectric type or magnetorestrictive type can be used. The frequency may vary over a relatively wide range of say 10 to 100 kilocycles or more. The power input to the ultra-sonic generator may vary over the range 30 to 200 watts or more. In general, higher frequencies and power inputs give smaller particle sizes.

As pointed out above, in order to obtain the desired sub-micron ammonium perchlorate particles, it is necessary that a coating agent be used. The coating agent may be a surface active agent or a hydrocarbon polymer or a very finely divided inert solid.

Typical surface active agents that may be used in the present process include:

1. Aerosol OT — Sodium dioctyl sulfosuccinate

2. British Detergent:

| | | Wt. % |
|---|---|---|
| (1) | Ethyl Oleate | 40 |
| (2) | Pentaerythritol Dioleate | 30 |
| (3) | Sodium Dioctyl Sulfosuccinate | 30 |
| | Total | 100 |

3. Monawet MO: 70% Sodium Dioctyl Sulfosuccinate
10% Butyl Carbitol
20% Water

4. Monawet MT: 80% Sodium Di-tridecyl Sulfosuccinate
20% Hexylene Glycol

5. Victamine C

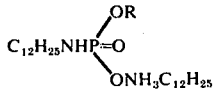

-continued

6. Victamine D

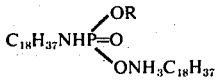

7. A di-imino-amido compound of the formula:

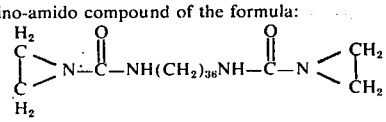

8. HX-740

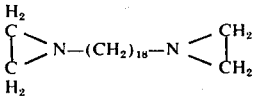

9. Ammonyx G Cetyldimethylbenzyl Ammonium Bromide

10. COPA-III

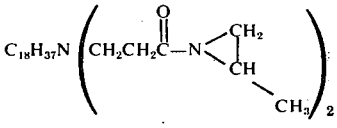

11. Ethoquad

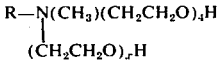

12. Hexamethyphosphoric Triamide

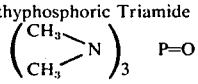

13. Nopcogen 22-0

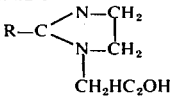

14. Diethylamine

15. Lecithin

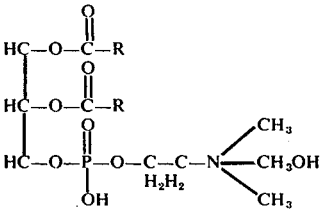

16. Di(beta-aziridinylethyl)-benzene

17. Sole-Terge-TS-2-S

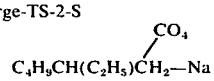

18. RC 2-960

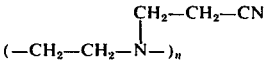

19. RC 2-959

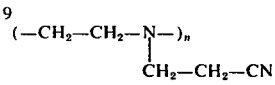

Examples of finely divided solids that may be used as coating agents in the present process include a finely divided aluminum oxide sold under the tradename ALON-T and a finely divided silica sold under the tradename Cab-O-Sil. The quantity of coating agent is desirably selected on the basis of the amount of ammonium perchlorate that is suspended in the non-solvent after evaporation of the solvent, rather than on the basis of quantity of non-solvent present. On this basis the amount of coating agent may vary from say about 0.5 to 10% by weight of the ammonium perchlorate and is preferably within the range 1 to 3% by weight, except in the case of the hydrocarbon polymers as particularly pointed out below.

The hydrocarbon polymers used as coating agents are viscous liquid carboxyl-terminated linear hydrocarbon polymers having viscosities within the range of about 50 to 2000 poises and molecular weights between about 500 and 10,000. One suitable type of such polymer is disclosed in Berenbaum et al. U.S. Pat. No. 3,235,589. As indicated in the Berenbaum et al. patent, the backbone of the hydrocarbon polymer may be composed of units derived from butadiene, isoprene or mixtures of butadiene and isoprene and may contain minor amounts of units derived from styrene and acrylonitrile. The carboxyl-terminated hydrocarbon polymer may also be of the type disclosed in Hunter et al. U.S. Pat. No. 3,563,966, which discloses carboxyl-terminated copolymers of butadiene and/or isoprene and acrylic acid. Mixtures of the various coating agents mentioned above may also be used.

When the carboxyl-terminated hydrocarbon polymer is used without a surface active agent it is desirably employed in concentrations somewhat higher than the surface active agent, for example, from 5% to 25% by weight of the ammonium perchlorate suspended in the non-solvent. When the hydrocarbon polymer is used in conjunction with a surface active agent, smaller amounts in the range of say 0.5 to 5% by weight of the ammonium perchlorate can be used to provide adequate coating of the ammonium perchlorate particles with the polymer.

In carrying out the process of the invention, relatively dilute solutions of the ammonium perchlorate are prepared and mixed with the non-solvent. The ammonium perchlorate concentration in the solvent solution may vary from say 0.1% by weight to the saturation point of the solvent used. The quantity of ammonium perchlorate solution added to the non-solvent may vary on a weight basis from say 1:3 to 3:1. However, in most cases it has been found desirable to use approximately equal quantities of the ammonium perchlorate solution and the non-solvent. Removal of the solvent from the mixture of solution and non-solvent should be effected relatively rapidly. It is thus desirable that the non-solvent be heated to a temperature at least as high as the boiling point of the solvent liquid and preferably to a temperature at or near the boiling point of the non-solvent liquid before the ammonium perchlorate solution is added to and mixed therewith.

Illustrative apparatus for carrying out the process of the invention is shown diagrammatically in the accompanying drawing. It is, of course, to be understood that the apparatus does not constitute a part of the invention and many different types of apparatus could be used. Referring to the drawing, the numeral 10 generally designates a mixing tank for preparing the ammonium perchlorate solution. Tank 10 is provided with an impeller 12 driven by a motor 14. The ammonium perchlorate solvent, e.g., acetone or methanol, is introduced into the tank 10 through a pipe 16 and ammonium perchlorate from a hopper 18 flows through pipe 20 into tank 10. Mixing of the ammonium perchlorate with the solvent and dissolution of the ammonium perchlorate in the solvent is promoted by the motor driven impeller 12.

The bottom of tank 10 is connected to a precipitator tank generally designated 22 by a pipe 24 containing a valve 26. Precipitator tank 22 is spring mounted by means of the springs 28 and 30 and is provided with an ultra-sonic generator 32 by means of which it may be vibrated at a desired frequency. Surrounding tank 22 there is a steam jacket 34 to which steam is supplied through a pipe 36 and from which condensate is withdrawn through a pipe 38.

Tank 22 is initially charged with non-solvent and coating agent to the level L-1 through a pipe 40 connected to the top of the tank 22 and having a control valve 42. The non-solvent is heated to a temperature near its boiling point by heat from the steam jacket 34. Valve 26 is then opened to cause the ammonium perchlorate solution from mixing tank 10 to start flowing into the precipitator tank through a distributor head 44.

Ultra-sonic vibrator 32 is then actuated to agitate the mixture in the precipitator tank. Heating of the mixture is continued to vaporize the solvent, and the solvent vapors containing a minor proportion of non-solvent vapors flow through pipe 46 to a fractionating column 48, the bottom of which is heated by a steam coil 50 supplied with steam through a pipe 52. Condensate is removed from coil 50 through a pipe 54.

With column 48 the solvent and non-solvent are separated and the non-solvent is returned to the precipitator tank 22 through a pipe 56. Vapors from the top of column 48 flow through pipe 58 to a condenser 60 supplied with cooling water through a pipe 62. Within condenser 60 the solvent vapors are condensed and the condensate is removed from the condenser through pipe 64. A portion of the condensate from pipe 64 is returned as reflux through pipe 66 containing valve 68 to the top of column 48. The remainder of the solvent condensate flows through pipe 70 to the mixing tank 10.

As the solvent is vaporized from the precipitator tank, sub-micron particles of ammonium perchlorate are formed in and remain suspended in the non-solvent liquid in the precipitator tank. The particles as formed are coated with the coating agent and thus their growth is inhibited to maintain them at the desired sub-micron size. When substantially all of the solution from tank 10 has been added to tank 22 and the solvent has been vaporized, the non-solvent suspension of ammonium perchlorate particles is withdrawn from tank 22 through pipe 72 containing valve 74. The suspension is concentrated by evaporation of the non-solvent in a suitable evaporator (not shown). As pointed out above, the ammonium perchlorate may be recovered as a slurry, a paste or a coated powder as desired.

While the apparatus shown in the drawing is designed for batch operation, it will be recognized by those skilled in the art that the process can be readily carried out on a continous basis. Thus non-solvent evaporated from the suspension removed through pipe 72 can be condensed and recycled to the mixing tank 10 and suitable controls can be used for maintaining a desired continuous flow of ammonium perchlorate, solvent and non-solvent to the system and removal of the non-solvent suspension from the system.

In order to point out more fully the nature of the present invention, the following specific Examples are given of illustrative embodiments of the process of the invention.

EXAMPLE 1

A 2,000 ml. beaker was charged with 500 ml. of m-xylene having dissolved therein 15 grams of a carboxylterminated polybutadiene of the type referred to above and having an average molecular weight of about 5,000 (ZL-434). A solution of ammonium perchlorate in methanol was prepared containing 1 gram of AP in 250 ml. of methanol. The m-xylene was heated to its boiling point and the AP solution added thereto slowly at atmospheric pressure from a separatory funnel at the rate of about 2 ml./min.

The boiling solution was agitated with an air-driven Cowles impeller rotating at 2,600 r.p.m. The methanol was rapidly flashed off and removed as it was added to the nonsolvent m-xylene. A certain amount of the m-xylene also vaporized and 170 ml. was added to the beaker during the course of the reaction.

Recrystallization and precipitation of the AP occurred in the non-solvent xylene as mixing of the two solutions and removal of the solvent progressed. The polymer formed a protective coating on the AP particles as they were formed. The polymer/AP ratio in the non-solvent phase was 15:1.

Recovery of the AP particles was effected by evaporating the m-xylene in which they were suspended. Analysis of the particles showed that they had a weight mean diameter as low as 0.52 microns.

EXAMPLE 2

A procedure similar to that of Example 1 was followed except that chlorobenzene was substituted for meta-xylene as the non-solvent. A methanol/AP solution containing 0.84% by weight of AP was used an a ratio of polymer to AP of 1:1 was used. Also the non-solvent phase contained about 0.01% of finely divided aluminum oxide (ALON-T).

The particle size of the resulting ammonium perchlorate was measured and found to be 0.80 microns.

EXAMPLE 3

Using essentially the procedure of Example 2, the methanol solution of AP was replaced by an acetone solution containing 1.01% of AP by weight.

The ammonium perchlorate particles recovered had a weight mean diameter of 0.72.

EXAMPLE 4

A 5,000 ml. two-port flask was provided with an impeller having a shaft extending through one port of the flask and sealed thereto by a gasket. The flask was charged with 5% by weight of lecithin and 5% by weight of the ZL 434 polymer of Example 1, the percentages of solutes being based on the weight of ammonium perchlorate to be added. The chlorobenzene was heated to its boiling point and the impeller rotated at about 5,000 r.p.m.

A solution of ammonium perchlorate in acetone containing about 1% by weight AP was prepared and added through the second port of the flask. The acetone vaporized rapidly upon contact with the hot chlorobenzene and acetone vapors were removed through the second port of the flask, condensed and collected for reuse. Recrystallization and precipitation of the AP occurred as mixing of the two solutions and removal of the acetone progressed. The ZL-434 polymer formed a protective coating in the AP particles as they formed.

Particle size analysis of the product showed that it had a weight mean diameter as low as 0.68 microns.

EXAMPLE 5

Freon 112 having dissolved therein 2% by weight of Monawet MT surfactant was charged to an ultra-sonic tank such as the tank 22 shown in the drawing. The Freon 112 solution was heated to its atmospheric temperature boiling point.

A solution of ammonium perchlorate in acetone containing 1% by weight of AP was added slowly to the boiling Freon 112 solution. During addition of the acetone solution, the non-solvent Freon 112 solution in the tank was irradiated with ultra-sonic energy at a frequency of 32 $KH_z$ and a power input of 50 watts. The acetone vaporized rapidly as it came in contact with the boiling Freon 112 and the vapor was removed from the tank, condensed and collected for re-use.

Recrystallization of and precipitation of the ammonium perchlorate occurred as mixing of the two solutions and removal of the solvent progressed. The ultra-sonic waves caused cavitation in the liquid which acted as nuclei for forming AP crystals and limited their growth. The Monawet coating agent formed a protective coating on the AP particles and also limited their growth.

Two runs were made using the foregoing procedure. Analysis of the products indicated particle sizes of 0.59 WMD and 0.71 WMD, respectively.

EXAMPLE 6

A number of additional runs were made using Freon 112 as the non-solvent, acetone as the solvent, and ultra-sonic irradiation at a frequency of 32 $KH_z$ and power input of 50 watts, but with variations in the coating agent and AP concentration as indicated in the following Table. The weight mean diameter of the ammonium perchlorate particles obtained is indicated in the last column of the Table.

| Coating Agent | AP Conc. | WMD of Particles |
|---|---|---|
| 2% COPA III | 1.00 | 0.88 |
| 2% Monawet MT in solvent and 2% in non-solvent | 1.00 | 0.64 |
| 2% Monawet MT | 2.00 | 0.99 |
| 1.7% Aerosol OT | 1.00 | 0.65 |
| 2% Monawet MT | 0.50 | 0.69 |
| 2% Monawet MT and 2% lecithin | 1.00 | 0.85 |

EXAMPLE 7

Several runs were made to determine the effect of varying the power input to the ultra-sonic tank during addition of the ammonium perchlorate solution to the non-solvent liquid. In these runs the non-solvent was a boiling solution of chlorobenzene containing 1% lecithin as a coating agent. A methanol solution of ammonium perchlorate containing 5% by weight of AP was added slowly to the boiling non-solvent as described in the preceding Examples.

During addition of the AP solution the mixture in the tank was subjected to ultra-sonic energy at a frequency of 20 $KH_z$. Runs were made at power levels of 0, 100 and 200 watts. The particle size at zero power level was 1.3 microns, 1.1 microns at 100 watts and at 200 watts was 0.90 microns. The relationship between particle size and power input was almost linear over the range used.

This Example shows that the particle size of the ammonium perchlorate particles produced by the present process can be varied by varying the power input to the ultra-sonic generator. Similarly, variations in particle size can be achieved by selectively varying the frequency of the ultrasonic generator. For example, using the procedure of Example 6, at a frequency of 32 $KH_z$ and a power level of 50 watts, a particle size of 0.7 microns was obtained, whereas at a frequency of 20 $KH_z$ and the same power level an average particle size of about 1.4 microns was obtained.

It is, of course, to be understood that the foregoing Examples are intended to be illustrative only and that numerous changes can be made in the ingredients, proportions and conditions illustratively disclosed, without departing from the scope of the invention as defined in the appended claims.

We claim:

1. A method of making ultra-fine ammonium perchlorate particles which comprises mixing a solution of ammonium perchlorate in a volatile liquid with a second less volatile liquid which is miscible with the first liquid and is a non-solvent for ammonium perchlorate, said mixture having dissolved therein a small amount of a coating agent selected from linear carboxylterminated, liquid, hydrocarbon polymers, finely divided inert solids, surface active agents and mixtures thereof, simultaneously agitating said mixture and vaporizing said solvent liquid to form a suspension of fine ammonium perchlorate particles in said second liquid and evaporating at least a part of said second liquid to recover said ammonium perchlorate particles.

2. A method according to claim 1 wherein said coating agent is dissolved in said second liquid.

3. A method according to claim 1 wherein said coating agent is a liquid carboxyl-terminated hydrocarbon polymer, said ammonium perchlorate particles have a sub-micron particle size and said particles are coated with said polymer.

4. A method according to claim 1 wherein said coating agent is a surface active agent.

5. A method according to claim 1 wherein said coating agent is a finely divided inert solid.

6. A method according to claim 1 wherein said first liquid is methanol or acetone.

7. A method according to claim 1 wherein said second liquid is symmetrical tetrachlorodifluoroethane, chlorobenzene or xylene.

8. A method according to claim 1 wherein said mixture is agitated with ultra-sonic vibrations.

9. A method according to claim 8 wherein said ultrasonic vibrations are in the range 10 to 100 $KH_z$.

10. A method according to claim 3 wherein said hydrocarbon polymer is a carboxyl-terminated polybutadiene.

11. A method according to claim 3 wherein said hydrocarbon polymer is a butadiene acrylic acid copolymer.

12. A method according to claim 1 wherein said second liquid is heated to a temperature above the boiling point of said volatile liquid before said solution and said second liquid are mixed.

13. A method according to claim 1 wherein said second liquid is heated to a temperature near its boiling point before said solution and said second liquid are mixed.

14. A method according to claim 1 in which said coating agent is a liquid hydrocarbon used in an amount of at least 15% by weight of said ammonium perchlorate particles and said second solvent is evaporated to form a paste in which said ammonium perchlorate particles are dispersed.

15. A method according to claim 1 in which said coating agent is a liquid hydrocarbon polymer used in an amount of 0.5 to 5% by weight of said ammonium perchlorate particles and said second solvent is evaporated to form finely divided perchlorate particles coated with said polymer.

16. A method of making ultra-fine ammonium perchlorate which comprises continuously mixing a solution of ammonium perchlorate in a volatile liquid with a second less volatile liquid which is miscible with the first liquid and has a small amount of coating agent dissolved therein, maintaining the resulting mixture at an elevated temperature to continuously vaporize said volatile liquid therefrom and cause fine ammonium perchlorate particles to form in said second liquid in suspension, continuously removing said suspension from said mixture and vaporizing at least a portion of said second liquid therefrom to recover fine particles of ammonium perchlorate therefrom.

17. Sub-micron particles of ammonium perchlorate coated with a coating agent.

18. Sub-micron particles of ammonium perchlorate coated with a surface active agent.

19. Sub-micron particles of ammonium perchlorate coated with a finely divided inert powder.

20. Sub-micron particles of ammonium perchlorate coated with a carboxyl-terminated, linear hydrocarbon polymer.

21. Sub-micron particles of ammonium perchlorate coated with a carboxyl-terminated polybutadiene having a molecular weight of 500 to 10,000.

22. A composition having a paste-like consistency said composition consisting essentially of a dispersion of sub-micron particles of ammonium perchlorate dispersed in a liquid hydrocarbon polymer, said composition containing from about 15% to about 25%, based on the weight of ammonium perchlorate, of said liquid polymer.

23. A composition according to claim 22 wherein said liquid polymer is a carboxyl-terminated polybutadiene having a molecular weight of 500 to 10,000.

* * * * *